US005115557A

United States Patent [19]

Visser et al.

[11] Patent Number: 5,115,557

[45] Date of Patent: May 26, 1992

[54] METHOD OF CONNECTING A CONDUCTOR WIRE TO A HOOK-SHAPED ELEMENT

[75] Inventors: Reinke A. Visser, Drachten; Adrianus R. C. Engelfriet; Klaus B. Schildbach, both of Eindhoven, all of Netherlands

[73] Assignee: U.S. Philips Corporation, New York, N.Y.

[21] Appl. No.: 578,049

[22] Filed: Sep. 5, 1990

[30] Foreign Application Priority Data

Sep. 7, 1989 [NL] Netherlands ..... 8902240

[51] Int. Cl.[5] ..... H01R 43/06

[52] U.S. Cl. ..... 29/597; 29/598; 310/71; 310/234

[58] Field of Search ..... 29/597, 598; 310/233, 310/234, 42, 71

[56] References Cited

U.S. PATENT DOCUMENTS 4,671,848 6/1987 Miller et al. .
4,835,430 5/1989 Siu .

FOREIGN PATENT DOCUMENTS 3542380 6/1987 Fed. Rep. of Germany .
1428054 3/1976 United Kingdom .

*Primary Examiner*—Carl E. Hall
*Attorney, Agent, or Firm*—William Squire

[57] ABSTRACT

The invention relates to a method of electrically and mechanically connected to a hook-shaped element of an electrically conductive supporting body. The conductor wire, which comprises an electrically conductive core and a sheath of an insulating material, is introduced into the open hook-shaped element after which a radiation beam is aimed at the conductor wire, for example, to ablate the insulating sheath by heating. After this the conductive core of the conductor wire is clamped in the hook-shaped element by cold deformation of the hook-shaped element.

3 Claims, 1 Drawing Sheet

METHOD OF CONNECTING A CONDUCTOR WIRE TO A HOOK-SHAPED ELEMENT

BACKGROUND OF THE INVENTION

1. Field of the Invention

Figure 1:
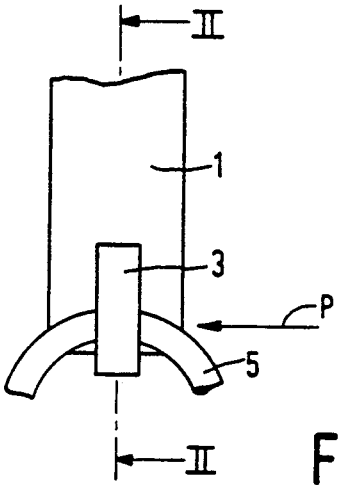

The invention relates to a method of electrically and mechanically connecting an electrical conductor wire to a hook-shaped element of an electrically conductive supporting body, the conductor wire, which comprises an electrically conductive core and a sheath of an insulating material, being introduced into the open hook-shaped element, upon which the hook-shaped element is closed under pressure.

The invention also relates to a rotor for an electrical machine, which rotor comprises a rotor winding and a commutator, and to a stator for an electrical machine, which stator comprises a stator winding and a connecting member.

2. Description of Prior Art

A method as defined above is disclosed in EP-0,280,386 which corresponds to U.S. Pat. No. 4,835,430, (herewith incorporated by reference). In accordance with the prior-art method a wire of a rotor coil is connected to a hook of a commutator segment by means of an electric current. For this purpose the wire is wrapped around the hook, after which the hook and the commutator segment are connected to electrodes. One of the electrodes is in contact with the commutator segment and another electrode is in contact with the hook, which is thus closed. An electric current is applied between the electrodes to heat the hook, the heat thus produced causing the insulation layer to be burnt off the wire and electrical contact to be established between the wire and the hook.

A drawback of the prior-art method is that during connection of the wire to the hook the hook and hence the adjacent constructional parts are heated to a high temperature, so that a comparatively large surrounding area is heated. In modern equipment comprising, for example, temperature-sensitive electronic devices such a thermal load is often impermissible. Moreover, the high temperatures impose limitations on the choice of the materials for the constructional parts.

EP-A 0,280,386 also discloses a rotor for an electrical machine, comprising a rotor winding and a commutator, a conductor wire of the rotor winding being connected to a hook-shaped element of the commutator. It is noted that DE-A 2,328,698 which corresponds to British Patent 1,428,054 discloses a method of connecting an armature wire to a commutator, the bare armature wire being introduced into an open hook of a commutator segment, after which the free end of the hook is bent towards the segment. The armature wire is then flattened to establish metallic contact between the armature wire and the segment. It is to be noted also that U.S. Pat. No. 4,671,848 describes a method of locally removing a dielectric coating from a wire by means of a high-energy radiation source such as a laser. Finally, it is to be noted that from DE-A 3,542,380 (herewith incorporated by reference) it is known per se to use a laser beam in a method in which a coil lead of a rotor winding and a commutator hook are welded to one another. In accordance with this known method the coil lead is introduced into a recess formed in the commutator hook, after which the lead is bent. After the commutator hook has been closed a pulsating or non-pulsating laser beam is aimed at the coil lead via the recess to form a weld between the coil lead and the commutator hook.

It is an object of the invention to improve the method defined in the opening paragraph in such a manner that no heating or only local heating is necessary to connect a conductor wire to a hook-shaped element.

To this end the method in accordance with the invention is characterized in that after introduction of the conductor wire into the open hook-shaped element a radiation beam is aimed at the conductor wire in the open hook-shaped element to ablate the insulating material, after which, upon the ablation, the conductive core of the conductor wire is clamped in the hook-shaped element by cold deformation of the hook-shaped element. Ablation is to be understood to mean removal as a result of melting, evaporation, burning or pulverising or a combination of two or more of these processes. The wavelength of the radiation used for this purpose may lie in the UV and/or IR region. When UV radiation is used the insulating material is pulverised.

SUMMARY OF THE INVENTION

An advantage of the method in accordance with the invention is that if UV radiation is employed substantially no heat is produced and if IR radiation is employed the heat is administered to the conductor wire, in particular the insulating sheath thereof, directly, locally and in a well-defined manner. An accurately defined and bounded radiation beam is obtained if a laser source is used. It is found that a TEA (=Transversely Excited Atmospheric) $CO_2$-laser is very suitable for the ablation of thin wires. Such a laser is capable of producing pulsating laser beams and high power densities.

An embodiment of the method in accordance with the invention, in which the insulating material is removed very effectively, is characterized in that a gas stream is aimed at the conductor wire in the open hook-shaped element during aiming of the radiation beam.

It is another object of the invention to provide the prior-art rotor with a connection between a conductor wire of the rotor winding and a hook-shaped element of the commutator, which connection is established by means of the method in accordance with the invention. During manufacture such a rotor is subjected to hardly any thermal load, which is beneficial for the life of the rotor. Moreover, the requirements as regards thermal sensitivity imposed on the materials of the rotor, in particular the commutator, can be less stringent, which generally leads to the choice of cheaper materials.

It is another object of the invention to provide a stator for an electrical machine, which stator comprises a stator winding and a connecting member, a conductor wire of the stator winding being connected to a hook-shaped element of the connecting member by means of the method in accordance with the invention.

IN THE DRAWING

Figure 2:
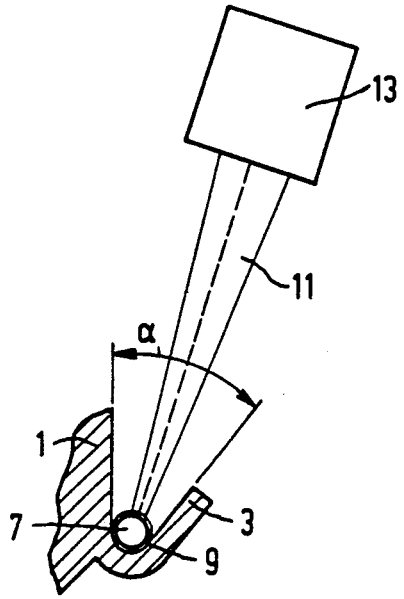
Figure 3:
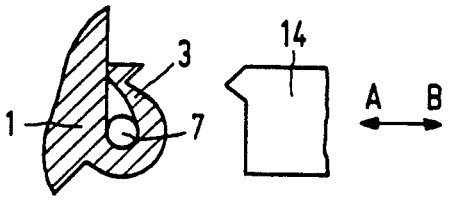
Figure 4:
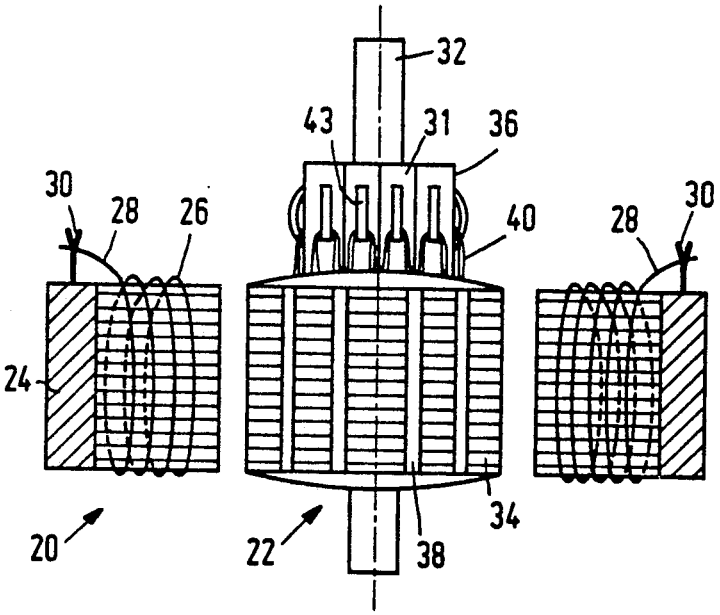
Figure 5:
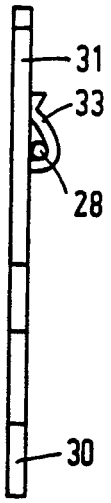

The invention will now be described in more detail, by way of example, with reference to the drawing, in which:

FIG. 1 is a side view of a part of a commutator segment with an open commutator hook, FIG. 2 shows a part of FIG. 1 in a sectional view taken on the lines II—II, FIG. 3 is a sectional view of the part of the commutator segment of FIG. 1, the commutator hook being closed by means of a closing die, FIG. 4 shows a plane view of an electric motor and a stator with various connecting members, and FIG. 5 shows one of the connecting members of the electric motor shown in FIG. 4.

FIGS. 1 and 2 show a part of a conductive supporting body 1 comprising a hook-shaped element 3. In the present example the supporting body is constructed as a commutator segment of a commutator of an electrical machine. For this reason the supporting body and the hook-shaped element will be referred to hereinafter as the commutator segment 1 and the commutator hook 3 respectively.

In FIG. 1 the commutator hook 3, which serves for electrically and mechanically connecting an electrical conductor wire, in the present example a coil lead 5 of a rotor winding, to the commutator segment 1, is open. The commutator hook 3 and the commutator segment 1 then extend, for example, at an angle alpha of 22° to each other. When the method in accordance with the invention is carried out the coil lead 5, which has a conductive core 7 of, for example, copper and an electrically insulating plastics sheath 9, is introduced into the space bounded by the commutator segment 1 and the open commutator hook 3, after which an infrared radiation beam 11, preferably produced by a laser source 13, for example a $CO_2$ laser, is aimed at the coil lead. The radiation beam 11 heats the coil lead 5 locally, causing the insulating sheath 9 of, for example, polyester imide to be subjected to such physical and chemical changes, for example melting or burning, that the conductive core 7 can be brought into electrical contact with the commutator segment 1 and the commutator hook 3. This may be achieved by aiming a gas stream at the coil lead 5, as is indicated by the arrow P, and in the cold condition the commutator hook 3 is bent towards the commutator segment 1 by a closing die 14 which is moved in the direction indicated by the arrow A, yielding the situation illustrated in FIG. 3, in which the coil lead core 7 is firmly clamped and is in electrical contact with the commutator segment 1 and the commutator hook 3. After the commutator hook 3 has been closed, which may be effected by means of a counter-die, the die 14 is removed by a movement in the direction indicated by the arrow B.

FIG. 4 shows an a.c. motor comprising a stator 20 and a rotor 22. The laminated stator 20 is surrounded with a plastics housing 24 and comprises a stator winding 26 having coil leads 28 connected to connecting members 30. FIG. 5 shows one of the connecting members 30 to an enlarged scale. The connecting member shown in this Figure comprises a plate-shaped supporting body 31 and a hook-shaped element 33, between which one of the coil leads 28 is clamped, the coil lead 28 being connected to the connecting member 30 by means of the method in accordance with the invention.

The rotor 22 of the electric motor shown in FIG. 4 comprises a rotor shaft 32 with a rotor body 34 and a commutator 36 with commutator segments 31. The rotor body 34 takes the form of a lamination assembly with radial slots 38 in which the coil sides of rotor coils, not shown, of a rotor winding are arranged. The rotor winding comprises coil leads 40, which are connected to hook-shaped elements 43 of the commutator segments 31. The commutator segments 31 and the hook-shaped elements 43 correspond to the commutator segment 1 and the commutator hook 3 shown in FIG. 3. The coil leads 40 are connected by means of the method in accordance with the invention.

What is claimed is:

1. A method of electrically and mechanically connecting an electrical conductor wire comprising an electrically conductive core and a sheath of insulating material to a hook-shaped electrically conductive body, said method comprising:

introducing the wire into the hook-shaped body while the hook is open;

ablating the insulating material of the wire in the open hook with a radiation beam;

aiming a gas stream at the wire in the open hook during the ablating to effectively remove the ablated insulating material; and after ablation, clamping the core in the hook-shaped body by cold deformation of the body.

2. A method as claimed in claim 1 wherein the ablating step includes generating the radiation beam with a laser source.

3. A method as claimed in claim 2 wherein the laser source is a TEA-$CO_2$ laser.

* * * * *